US005593229A

United States Patent [19]

Warr

[11] Patent Number: 5,593,229

[45] Date of Patent: Jan. 14, 1997

[54] HEAVY DUTY BAG WITH EASILY-REMOVABLE CORNER FOR POURING

[75] Inventor: Charles J. Warr, High Point, N.C.

[73] Assignee: Rex-Rosenlew International Corporation, Thomasville, N.C.

[21] Appl. No.: 500,173

[22] Filed: Jul. 10, 1995

[51] Int. Cl.[6] ..... B65D 33/36; B65D 33/08

[52] U.S. Cl. ..... 383/209; 383/10; 383/25; 383/109; 383/906

[58] Field of Search ..... 383/7, 25, 10, 383/200, 204, 207, 209, 906, 109

[56] References Cited

U.S. PATENT DOCUMENTS

| | | | |
|---|---|---|---|
| 2,050,967 | 8/1936 | Farmer | 383/16 X |
| 3,397,835 | 8/1968 | Henning | 383/209 X |
| 4,252,269 | 2/1981 | Peppiatt | 383/25 |
| 4,363,406 | 12/1982 | Salvadori | 383/200 |
| 4,557,385 | 12/1985 | Robinson . | |
| 4,770,912 | 9/1988 | Furrer et al. . | |
| 4,994,324 | 2/1991 | Bose et al. . | |
| 5,219,229 | 6/1993 | Sengewald | 383/207 |
| 5,482,376 | 1/1996 | Moseley et al. . | |

FOREIGN PATENT DOCUMENTS

| | | | |
|---|---|---|---|
| 4224639 | 1/1994 | Germany | 383/209 |
| 9011946 | 10/1990 | WIPO | 383/204 |
| 2010412 | 6/1992 | WIPO | 383/207 |
| 2021069 | 7/1992 | WIPO | 383/209 |

OTHER PUBLICATIONS

Ralston Purina Company, Butcher's Blend brand Dog Food, Feb. 12, 1995, St. Louis, MO.

*Primary Examiner*—Jes F. Pascua
*Attorney, Agent, or Firm*—W. Thad Adams, III, P.A.

[57] ABSTRACT

A bag including first and second walls having joined first and second opposed side edges, and an end edge and at least one seal line spaced from the end edge and extending laterally from one side to the other for sealing closed the end of the bag. In combination with the bag is the improvement comprising an easy-open corner portion of the bag. The corner includes a cut formed in both side walls closer to one side edge than the other and communicating with the end edge of the bag and extending towards the spaced-apart seal line, and a plurality of closely spaced-apart perforations in both side walls extending in a line from within close proximity of the cut to the closer side edge and forming a tear line for permitting a portion of the side walls, including a portion of the end edge of the bag, to be torn away from the bag in a progressive tearing motion to form a hole in the bag from which the contents can be poured without interference from a remaining portion of the end edge of the bag.

9 Claims, 6 Drawing Sheets

HEAVY DUTY BAG WITH EASILY-REMOVABLE CORNER FOR POURING

TECHNICAL FIELD AND BACKGROUND OF THE INVENTION

This invention relates to a heavy duty bag with provision for a corner pour spout, or pourer. The pourer is formed by tearing off a corner of the bag, leaving a hole through which the contents of the bag can be emptied by inverting the bag to the desired degree. In contrast to prior art structures, the entire corner of the bag, including the area above the end seal, is completely removed. This provides easier pouring in several different ways. First, a cut or notch in the top of the bag makes the tear easier to start. Second, clear visibility of the material being poured is not hampered by a flap of remaining bag. Third, the remaining flap cannot interfere with the stream of material being poured, possibly diverting the stream or causing it to take an odd shape larger size more difficult to accurately pour without spilling.

SUMMARY OF THE INVENTION

Therefore, it is an object of the invention to provide a bag with an easily removed corner which exposes a hole through which the contents can be poured.

It is another object of the invention to provide a bag with an easily removed corner wherein the entire corner of the bag is removed.

It is another object of the invention to provide a bag which includes a cut or notch in the end edge of the bag to assist in starting the tearing motion needed to remove the corner of the bag.

These and other objects of the present invention are achieved in the preferred embodiments disclosed below by providing a bag including first and second walls having joined first and second opposed side edges, and an end edge and at least one seal line spaced from the end edge and extending laterally from one side to the other for sealing closed the end of the bag. In combination with the bag is the improvement comprising an easy-open corner portion of the bag. The corner includes a cut formed in both side walls closer to one side edge than the other and communicating with the end edge of the bag and extending towards the spaced-apart seal line, and a plurality of closely spaced-apart perforations in both side walls extending in a line from within close proximity of the cut to the closer side edge and forming a tear line for permitting a portion of the side walls, including a portion of the end edge of the bag, to be torn away from the bag in a progressive tearing motion to form a hole in the bag from which the contents can be poured without interference from a remaining portion of the end edge of the bag.

According to one preferred embodiment of the invention, the bag includes two spaced-apart seal lines adjacent the end edge of the bag, an area between the two spaced-apart seal lines including an opening defining a handle.

According to another preferred embodiment of the invention, the perforated line has two segments. A first segment is perpendicular to the end edge and parallel to the first and second side edges, and a second segment extending from the first segment to the closer side edge.

Preferably, both the first and second segments are straight.

According to yet another preferred embodiment of the invention, the first segment extends in a straight line and the second segment extends in a curved line.

According to yet another preferred embodiment of the invention, the curve of the second segment is convex towards the end edge.

According to yet another preferred embodiment of the invention, the curve of the second segment is concave towards the end edge.

According to yet another preferred embodiment of the invention, the perforations define a single straight line extending diagonally from the end edge to the nearer side edge, and defines a part of the bag to be torn away which is substantially triangular.

According to yet another preferred embodiment of the invention, the second segment extends to the nearer side edge at an angle perpendicular to the first segment.

According to yet another preferred embodiment of the invention, the second segment extends to the nearer side edge at a 45 degree angle to the first segment.

According to yet another preferred embodiment of the invention, the second segment extends to the nearer side edge at a 30 degree angle to the first segment.

Preferably, the handle comprises a U-shaped, die-cut slit.

According to yet another preferred embodiment of the invention, the handle comprises a separately-formed handle assembly attached to the bag adjacent its end edge.

According to one preferred embodiment of the invention, a bag is provided which includes first and second polyolefin walls with a thickness of between 3 and 12 mils and having joined first and second opposed side edges, an end edge and at least one seal line spaced from the end edge and extending laterally from one side to the other for sealing closed the end of the bag. In combination with the bag is the improvement comprising an easy-open corner portion of the bag. The corner includes a cut formed in both side walls closer to one side edge than the other and communicating with the end edge of the bag and extending towards the spaced-apart seal line, and a plurality of closely spaced-apart perforations in both side walls extending in a line from within close proximity of the cut to the closer side edge and forming a tear line for permitting a portion of the side walls, including a portion of the end edge of the bag, to be torn away from the bag in a progressive tearing motion to form a hole in the bag from which the contents can be poured without interference from a remaining portion of the end edge of the bag.

According to another preferred embodiment of the invention, the side walls are monoextruded.

According to another preferred embodiment of the invention, the side walls are coextruded.

According to yet another preferred embodiment of the invention, the perforations are between 1/16th inch and 3/8th inch long.

According to yet another preferred embodiment of the invention, the perforations are between 1/16th inch and 3/8th inch apart from adjacent perforations.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
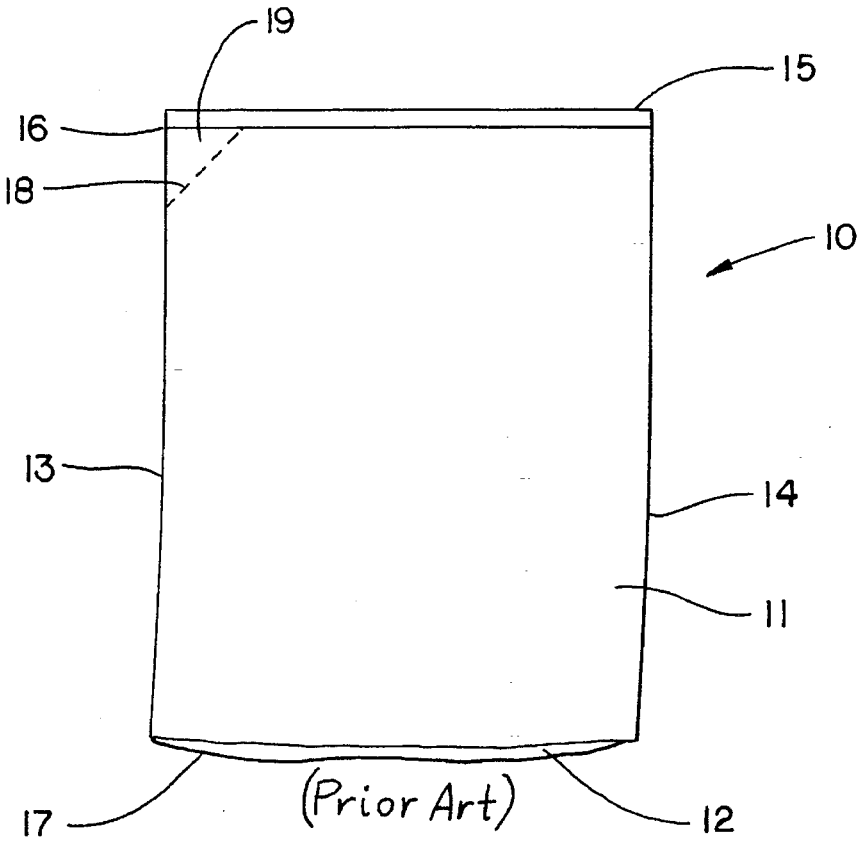
(Prior Art) FIG. 1
FIGS. 1, 2 and 3 illustrate side elevations of prior art bags which leave a flap of the bag above the pourer.
Figure 2:
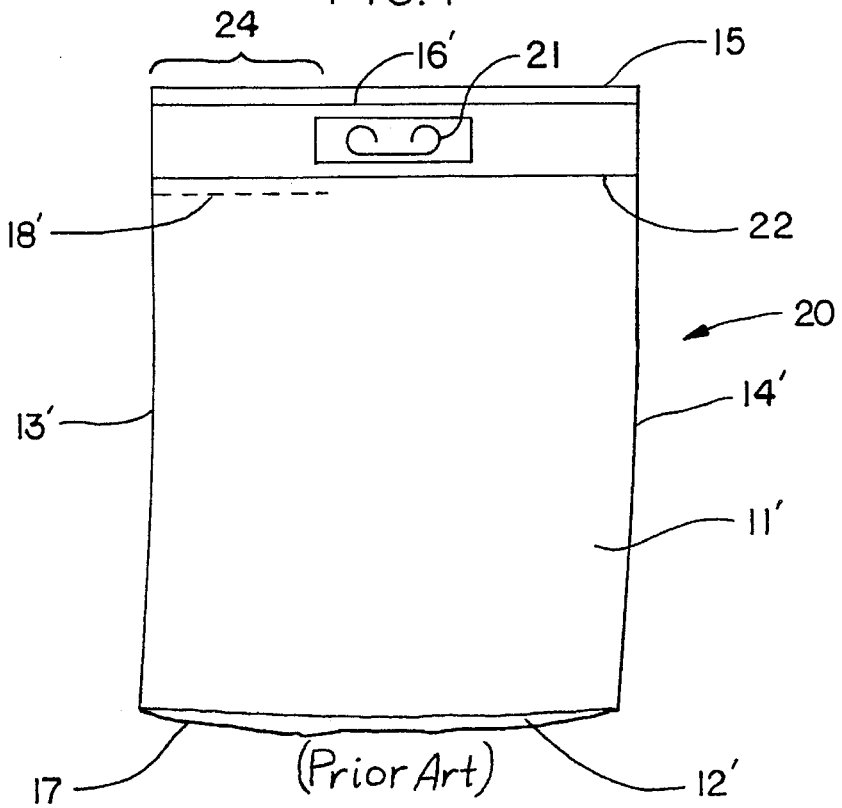
(Prior Art) FIG. 2
Figure 3:
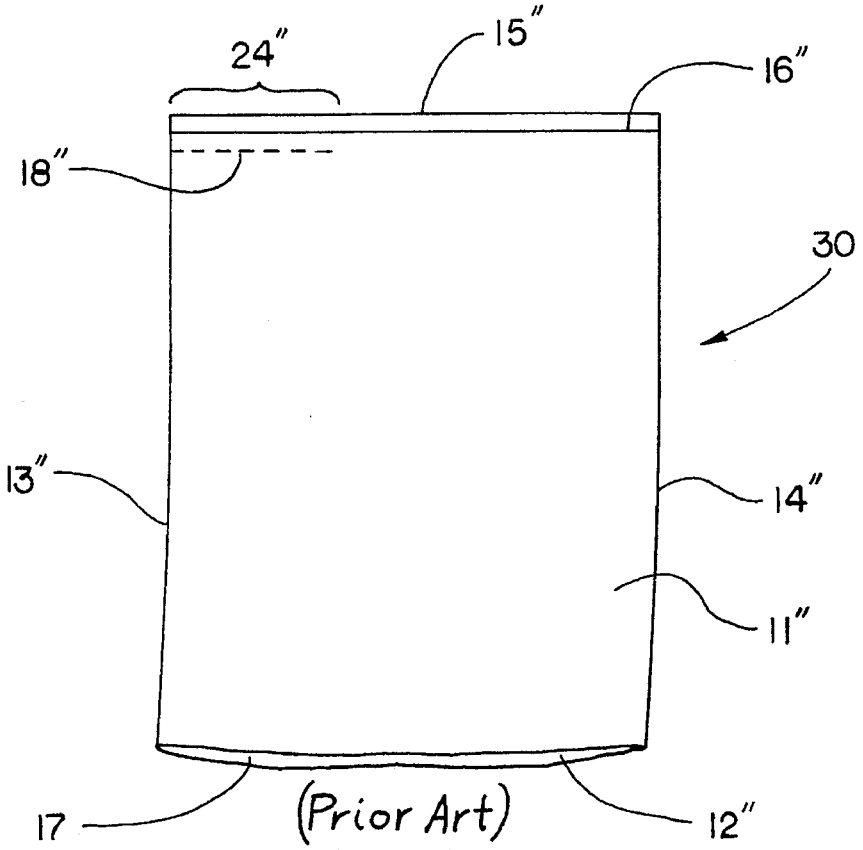
(Prior Art) FIG. 3

Referring now to FIGS. 1, 2 and 3, three illustrative prior art bag constructions are shown. Like elements in FIGS. 1–3 are referred to by the prime and double-prime reference numerals. In FIG. 1, a bag 10 is formed from thermoplastic sheet stock, for example, polyolefin polymer, and has overlying walls 11 and 12, defining opposed, closed side edges 13 and 14.

The top end edge 15 of the bag 10 is closed by a seal 16 formed by heat-fusing the thermoplastic walls 11 and 12 together along a narrow, straight line to form a tube, as shown. The bottom edge 17 of the bag 10 remains open so that the bag is filled from the bottom before being sealed shut. By convention, the edge 15 is considered the top of the bag and edge 17 the bottom, with filling taking place through the bottom.

Prior art bag 10 includes a diagonal line of perforations 18, which extend diagonally from the seal 16 downwardly to the side edge 13. To open the bag 10, the bridges, i.e., the wall material of the bag separating the perforations from each other, are ruptured by tearing. The perforations 18 define a line of weakness so that the tear extends along the line of perforations 18. Once all of the perforations are ruptured, an opening is formed in the corner of the bag 10 through which the contents can be poured. However, the corner portion 19 formed by tearing along the perforations 18 remains attached to the bag 10 at and above the seal 16. Without perforations above the seal 16, the user runs the risk of opening the bag 10 along its top end edge 15 if tearing is continued past where the perforations 18 end towards the top end edge 15.

Pouring accurately from the bag 10 can be difficult, because the attached corner portion 19 may block visibility, and may impinge into the stream of contents flowing from the bag, diverting the flow and causing spills.

A similar problem exists with the structure shown in FIG. 2. A bag 20 is formed from thermoplastic sheet stock, and has overlying walls 11' and 12', defining opposed, closed side edges 13' and 14'. The top end edge 15' of the bag is closed by a seal 16' formed by heat-fusing the thermoplastic walls 11' and 12' together along a narrow, straight line, as shown.

A U-shaped slit 21 is die-cut into the area below seal 16' to form a carry handle when the hand is extended through the slit 21. Another seal 22 extends from the side edge 13' to the side edge 14' and defines the upper closure of the contents-holding portion of the bag 20. The bottom edge 17' of the bag 10 remains open for filling.

Prior art bag 20 includes a line of perforations 18', which extend laterally outwardly along the walls 11 and 12 to the side edge 13 just below the seal 22. To open the bag 20, the bridges between the perforations are ruptured by tearing, as described above. An opening is formed in the corner of the bag 20 through which the contents can be poured. The bag material in the handle area above the opening, indicated by bracketed area 24, remains attached to the bag 20 at and above the seals 16' and 22. Without perforations above the seals 16' and 22, the user runs the risk of opening the bag 20 along its top end edge 15' if tearing is continued past where the perforations 18' end towards the top end edge 15'. This is a more substantial problem with bag 20, since the area above the opening formed by the perforations is substantially greater in depth, and would require a substantially longer tear to remove the area completely.

In FIG. 3, a bag 30 is formed from thermoplastic sheet stock, and has overlying walls 11" and 12", defining opposed, closed side edges 13" and 14". The top end edge 15" of the bag is closed by a seal 16" formed by heat-fusing the thermoplastic walls 11" and 12" together along a narrow, straight line, as shown. The bottom edge 17" of the bag 30 remains open so that the bag is filled from the bottom before being sealed shut.

Prior art bag 30 includes a line of perforations 18", which extend diagonally from the seal 16" downwardly to the side edge 13". To open the bag 30, the bridges between the perforations are ruptured by tearing. The perforations 18" define a line of weakness so that the tear extends along the line of perforations 18". Once all of the perforations are ruptured, an opening is formed in the corner of the bag 20 through which the contents can be poured. However, the bag material in the area above the opening, indicated by bracketed area 24" remains attached to the bag 30 at and above the seal 16' formed by tearing along the perforations 18" remains attached to the bag 30 at and above the seal 16". Without perforations above the seal 16", the user runs the risk of opening the bag 30 along its top end edge 15" if tearing is continued past where the perforations 18" end towards the top end edge 15", as with FIGS. 1 and 2.

Pouring accurately from the bag 30 can be difficult, because the attached material in the bracketed area 24" may block visibility, and may impinge into the stream of contents flowing from the bag, diverting the flow and causing spills.

Figure 4:
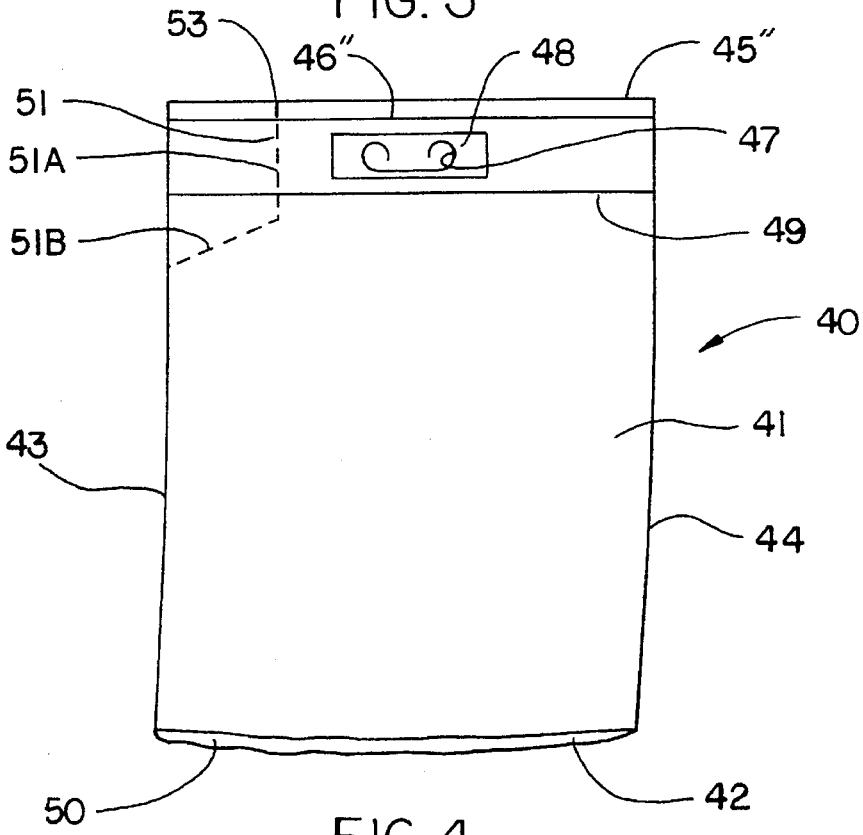
FIG. 4 is a side elevation of a bag according to an embodiment of the present invention.

With the structure of the prior art bags of FIGS. 1, 2 and 3 in mind, the invention of the application is illustrated in FIGS. 4–10. Referring now specifically to FIG. 4, a bag 40 according to the invention is shown. Bag 40 is formed from thermoplastic sheet stock, and has overlying walls 41 and 42, defining opposed, closed side edges 43 and 44. The embodiments shown in this application, including bag 40, are directed for purposes of example and illustration to a flat tube-type bag. The top end edge 45 of the bag is closed by a seal 46 formed by heat-fusing the thermoplastic walls 41 and 42 together along a narrow, straight line to form a flat tube when the bag is empty, as shown.

A U-shaped slit 47 is die-cut into the area below seal 46 to form a carry handle when the hand is extended through the slit 47. Another seal 49 extends from the side edge 43 to the side edge 44 and defines the upper closure of the contents-holding portion of the bag 40. Preferably, the handle formed by the slit 47 remains tacked to the surrounding material by one or more small uncut areas, until being broken when the handle is needed.

The handle area is reenforced by an additional patch 48, such as thermoplastic sheet stock, which is adhered to the area overlaying and surrounding the slit 47, and provides enhanced strength to the handle area of the bag 40. The bottom edge 50 of the bag 40 remains open for filling.

Bag 40 includes a line of perforations 51, which extend laterally outwardly along the walls 11 and 12 to the side edge 13 just below the seal 22. The line of perforations 51 comprises two line segments: a line segment of perforations 51A which extends from immediately below the top end edge 45 perpendicular to the top end edge 45 and parallel to the first and second side edges 41 and 42, and a line segment of perforations 51B extending from the adjacent end of the line segment 51A to the closer side edge 43.

A notch 53 in both the walls 41 and 42 communicating with the top end edge 45 at the adjacent end of the line segment 51A forms a place to start the tear. To open the bag 40, the bag is gripped near the notch 53 and the notch is enlarged by pulling the bag on opposite sides of the notch 53 apart. The tearing motion extends the notch into the line segment 51A, and the bridges between the perforations are ruptured by tearing. The tear extends down the line segment 51A and then diagonally down towards the side edge 43 along the line segment 51B. The corner segment is thus completely severed from the bag 40. An opening is formed in the corner of the bag 40 through which the contents can be poured. Material can be poured from the bag with complete visibility and without diverting the flow of material, because the bag material severed to form the opening is completely removed and discarded.

Figure 5:
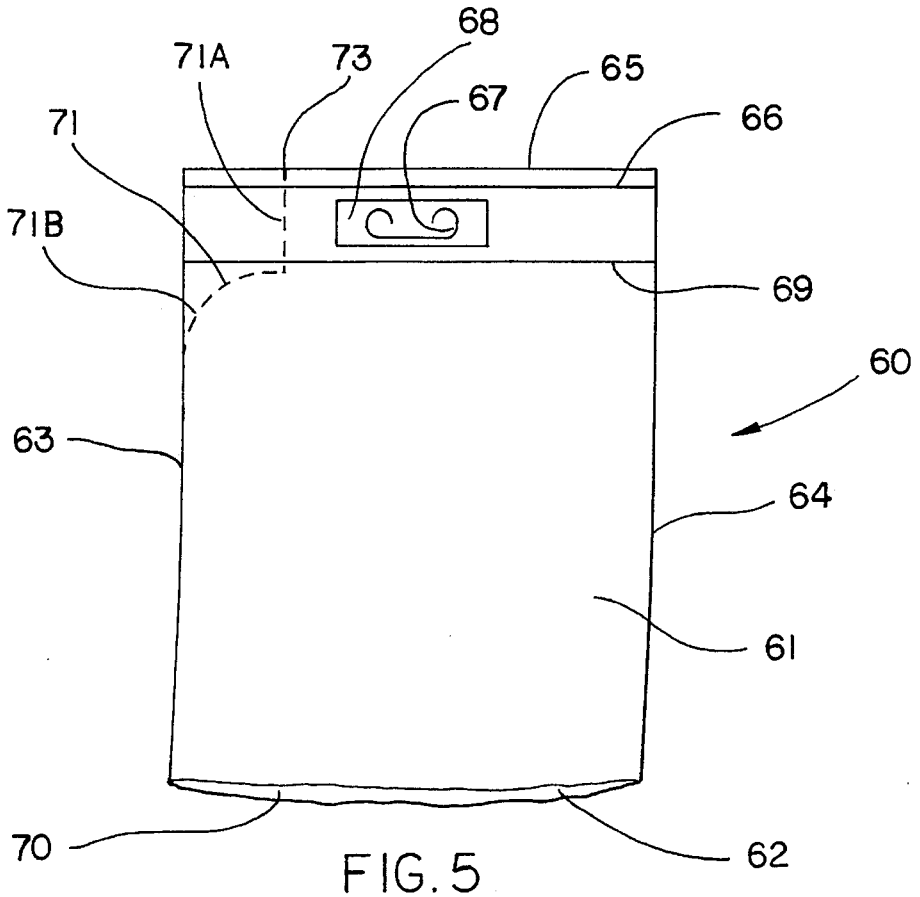
FIG. 5 is a side elevation of a bag according to an alternative embodiment of the present invention.

Referring now to FIG. 5, a bag 60 is formed from thermoplastic sheet stock, and has overlying walls 61 and 62, defining opposed, closed side edges 63 and 64. The top end edge 65 of the bag is closed by a seal 66 formed by heat-fusing the thermoplastic walls 61 and 62 together along a narrow, straight line, as shown. A U-shaped slit 67 is die-cut into the area below seal 66 to form a carry handle when the hand is extended through the slit 67. Another seal 69 extends from the side edge 63 to the side edge 64 and defines the upper closure of the contents-holding portion of the bag 60. Preferably, the handle formed by the slit 67 remains tacked to the surrounding material by one or more small uncut areas until being broken when the handle is needed.

The handle area is reenforced by an additional patch 68, such as thermoplastic sheet stock, which is adhered to the area overlaying and surrounding the slit 67, and provides enhanced strength to the handle area of the bag 60. The bottom edge 70 of the bag 60 remains open for filling.

Bag 60 includes a line of perforations 71, which extend along the walls 61 and 62 from the top end edge 65. The line of perforations 71 comprises two line segments: a line segment of perforations 71A which extends from immediately below the top end edge 65 perpendicular to the top end edge 65 and parallel to the first and second side edges 61 and 62, and a line segment of perforations 71B extending in a convex, curved orientation from the adjacent end of the line segment 71A to the closer side edge 63. As shown in FIG. 5, the convexity is directed towards the corner of the bag in the direction of the top end edge 65.

A notch 73 in both the walls 61 and 62 communicating with the top end edge 65 at the adjacent end of the line segment 61A forms a place to start the tear. To open the bag 60, the bag is gripped near the notch 73 and the notch is enlarged by pulling the bag on opposite sides of the notch 73 apart. The tearing motion extends the notch 73 into the line segment 71A, and the bridges between the perforations are ruptured by tearing. The tear extends down the line segment 71A and then diagonally down towards the side edge 62 along the line segment 71B. The corner segment is thus completely severed from the bag 60. An opening is formed in the corner of the bag 60 through which the contents can be poured. Material can be poured from the bag with complete visibility and without diverting the flow of material, because the bag material severed to form the opening is completely removed and discarded.

Figure 6:
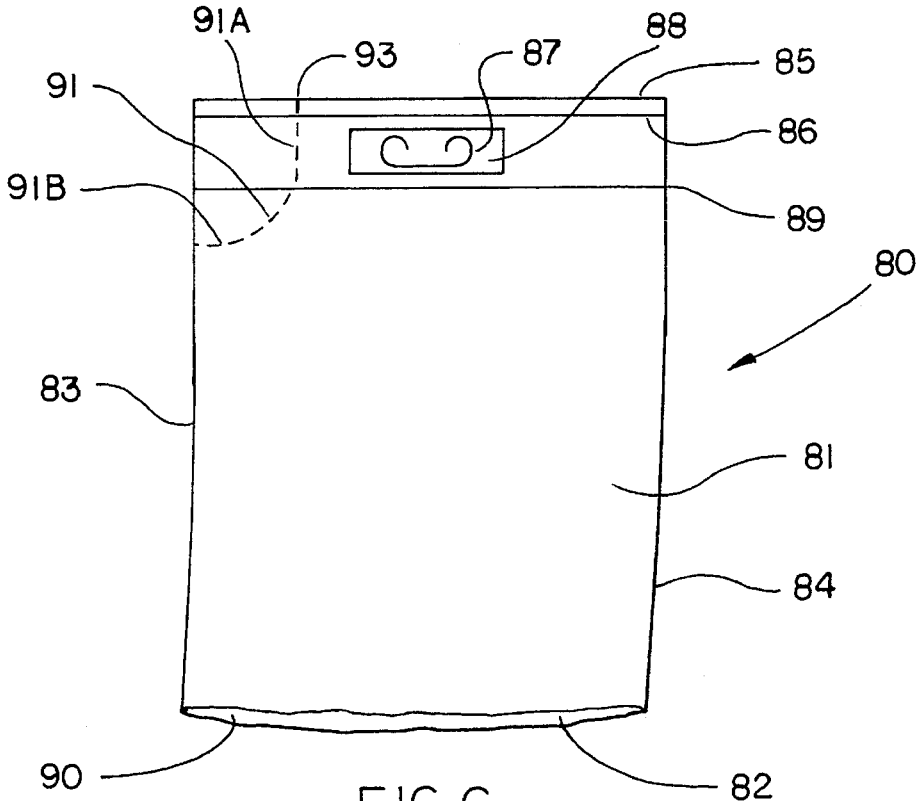
FIG. 6 is a side elevation of a bag according to an alternative embodiment of the present invention.

Referring now to FIG. 6, a bag 80 is formed from thermoplastic sheet stock, and has overlying walls 81 and 82, defining opposed, closed side edges 83 and 84. The top end edge 85 of the bag is closed by a seal 86 formed by heat-fusing the thermoplastic walls 81 and 82 together along a narrow, straight line, as shown. A U-shaped slit 87 is die-cut into the area below seal 86 to form a carry handle when the hand is extended through the slit 87. Another seal 89 extends from the side edge 83 to the side edge 84 and defines the upper closure of the contents-holding portion of the bag 80. Preferably, the handle formed by the slit 87 remains tacked to the surrounding material by one or more small uncut areas until being broken when the handle is needed.

The handle area is reenforced by an additional patch 88, such as thermoplastic sheet stock, which is adhered to the area overlaying and surrounding the slit 87, and provides enhanced strength to the handle area of the bag 80. The bottom edge 90 of the bag 80 remains open for filling.

Bag 80 includes a line of perforations 91, which extend along the walls 81 and 82 from the top end edge 85. The line of perforations 91 comprises two line segments: a line segment of perforations 91A which extends from immediately below the top end edge 85 perpendicular to the top end edge 85 and parallel to the first and second side edges 81 and 82, and a line segment of perforations 91B extending in a concave, curved orientation from the adjacent end of the line segment 91A to the closer side edge 83. As shown in FIG. 6, the concavity is directed towards the corner of the bag in the direction of the top end edge 85.

A notch 93 in both the walls 81 and 82 communicating with the top end edge 85 at the adjacent end of the line segment 91A forms a place to start the tear. To open the bag 80, the bag is gripped near the notch 93 and the notch is enlarged by pulling the bag on opposite sides of the notch 93 apart. The tearing motion extends the notch 93 into the line segment 91A, and the bridges between the perforations are ruptured by tearing. The tear extends down the line segment 91A and then diagonally down towards the side edge 83 along the line segment 91B. The corner segment is thus completely severed from the bag 80. An opening is formed in the corner of the bag 80 through which the contents can be poured. Material can be poured from the bag with complete visibility and without diverting the flow of material, because the bag material severed to form the opening is completely removed and discarded.

Figure 7:
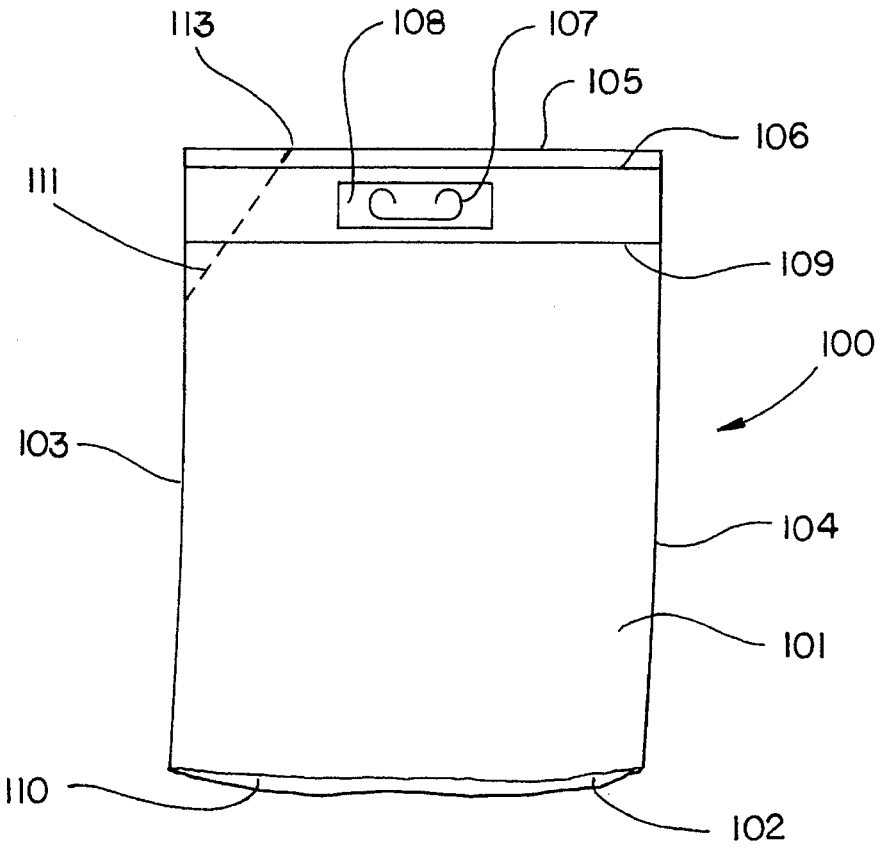
FIG. 7 is a side elevation of a bag according to an alternative embodiment of the present invention.

Referring now to FIG. 7, a bag 100 is formed from thermoplastic sheet stock, and has overlying walls 101 and 102, defining opposed, closed side edges 103 and 104. The top end edge 105 of the bag is closed by a seal 106 formed by heat-fusing the thermoplastic walls 101 and 102 together along a narrow, straight line, as shown. A U-shaped slit 107 is die-cut into the area below seal 106 to form a carry handle when the hand is extended through the slit 107. Another seal 109 extends from the side edge 103 to the side edge 104 and defines the upper closure of the contents-holding portion of the bag 100. Preferably, the handle formed by the slit 107 remains tacked to the surrounding material by one or more small uncut areas until being broken when the handle is needed.

The handle area is reenforced by an additional patch 108, such as thermoplastic sheet stock, which is adhered to the area overlaying and surrounding the slit 107, and provides enhanced strength to the handle area of the bag 100. The bottom edge 110 of the bag 100 remains open for filling.

Bag 100 includes a line of perforations 111, which extend along the walls 101 and 102 from the top end edge 105. The line of perforations 111 comprises a single line segment which extends from a point immediately adjacent the top end edge 105 in a straight line diagonally downwardly to the closer side edge 103.

A notch 113 in both the walls 101 and 102 communicating with the top end edge 105 at the adjacent end of the line of perforations 111 forms a place to start the tear. To open the bag 100, the bag is gripped near the notch 113 and the notch is enlarged by pulling the bag on opposite sides of the notch 113 apart. The tearing motion extends the notch 113 into the line of perforations 111 and the bridges between the perforations are ruptured by tearing. The tear extends down the line of perforations 111 diagonally down towards the side edge 103. The corner segment is thus completely severed from the bag 100. An opening is formed in the corner of the bag 100 through which the contents can be poured. Material can be poured from the bag with complete visibility and without diverting the flow of material, because the bag material severed to form the opening is completely removed and discarded.

Figure 8:
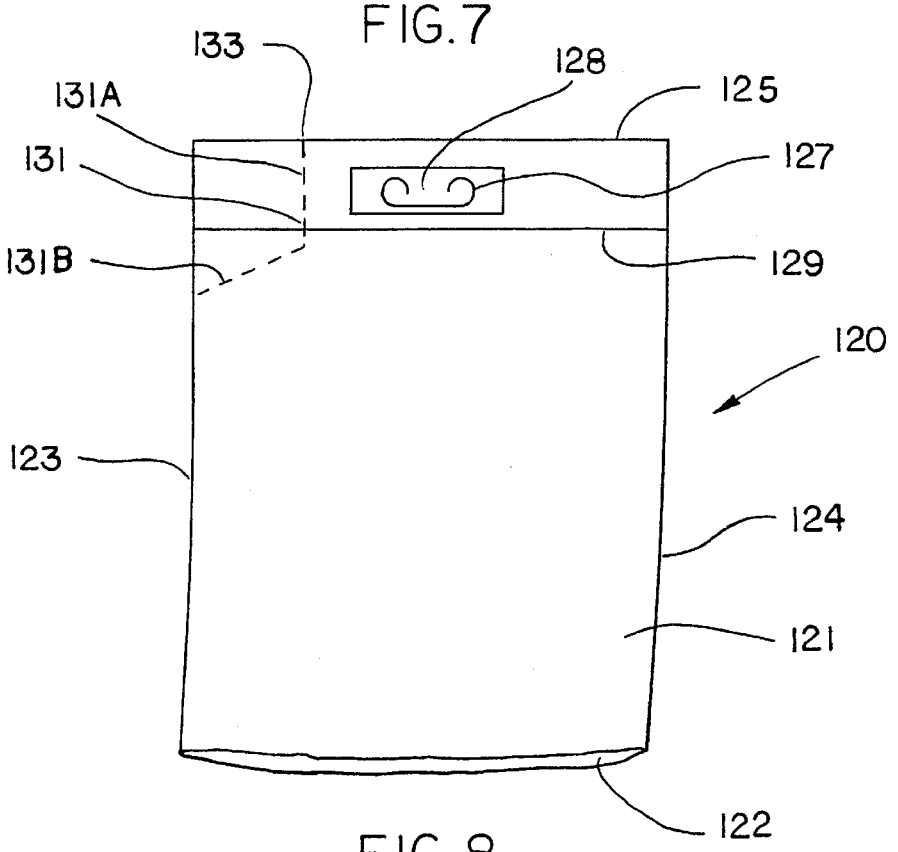
FIG. 8 is a side elevation of a bag according to an alternative embodiment of the present invention.

Referring now to FIG. 8, a bag 120 is formed from thermoplastic sheet stock, and has overlying walls 121 and 122, defining opposed, closed side edges 123 and 124. A U-shaped slit 127 is die-cut into the area below the top end edge 125 to form a carry handle when the hand is extended through the slit 127. A seal 129 extends from the side edge 123 to the side edge 124 and defines the upper closure of the contents-holding portion of the bag 120, with the carry handle positioned above. Preferably, the handle formed by the slit 127 remains tacked to the surrounding material by one or more small uncut areas until being broken when the handle is needed.

The handle area is reenforced by an additional patch 128, such as thermoplastic sheet stock which is adhered to the area overlaying and surrounding the slit 127, and provides enhanced strength to the handle area of the bag 120. The bottom edge 122 of the bag 120 remains open for filling.

Bag 120 includes a line of perforations 131, which extend along the walls 121 and 122 from the top end edge 125. The line of perforations 131 comprises a line segment of perforations 131A which extends from a point immediately adjacent the top end edge 125 in a straight line downwardly perpendicular to the top end edge 125 and parallel to the side edges 123 and 124. A line segment of perforations 131B extends diagonally downwardly from the lower end of the line segment 131A to the closer side edge 123.

A notch 133 in both the walls 121 and 122 communicating with the top end edge 125 at the adjacent end of the line of perforations 131 forms a place to start the tear. To open the bag 120, the bag is gripped near the notch 133 and the notch is enlarged by pulling the bag on opposite sides of the notch 133 apart. The tearing motion extends the notch 133 into the line of perforations 131 and the bridges between the perforations are ruptured by tearing. The tear extends down the line of perforations 131 downwardly along line segment 131A and then diagonally down the line segment 131B towards the side edge 123. The corner segment is thus completely severed from the bag 120. An opening is formed in the corner of the bag 120 through which the contents can be poured. Material can be poured from the bag with complete visibility and without diverting the flow of material, because the bag material severed to form the opening is completely removed and discarded.

Figure 9:
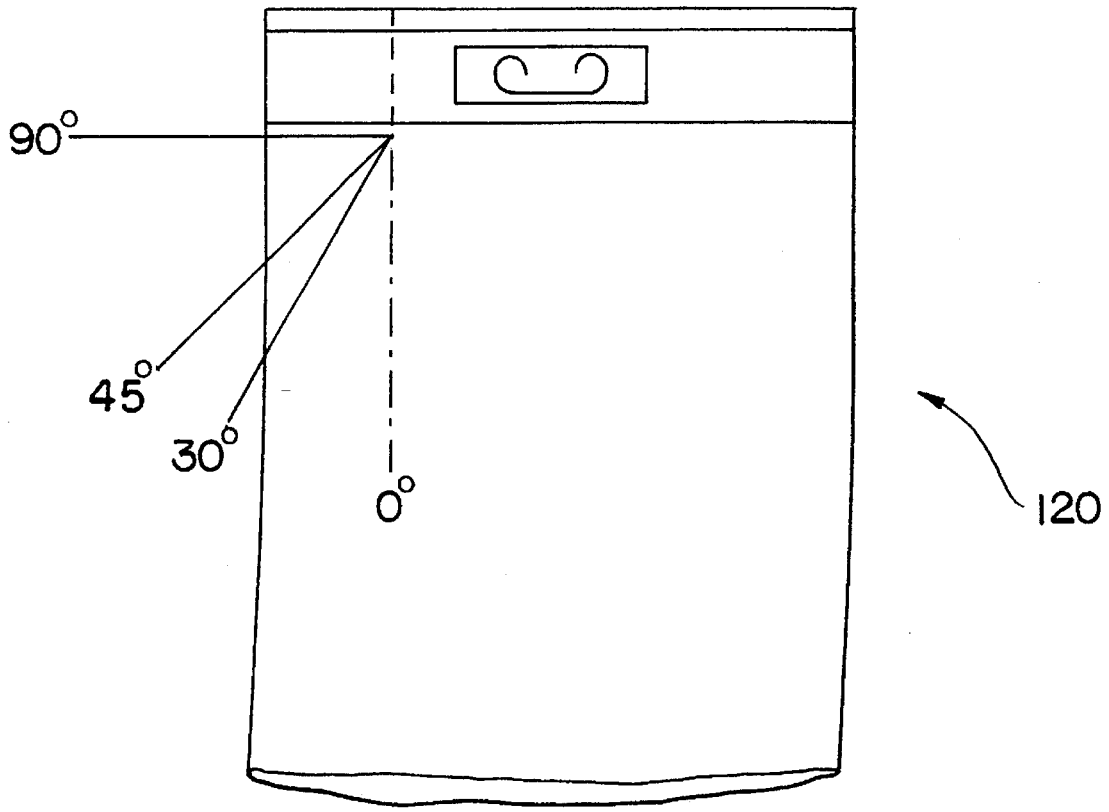
FIG. 9 is a side elevation of a bag representing the varying angles of the first and second segments of the perforations relative to each other.

Referring now to FIG. 9, the bag of the type like bag 120 is shown diagrammatically and illustrates that the angle of the line segment 131B can extend at any angle between 30 degrees and 90 degrees from the angle of the line segment 131A. The greater the angle between the two line segments, the smaller the opening formed when the corner portion is removed for pouring.

Figure 10:
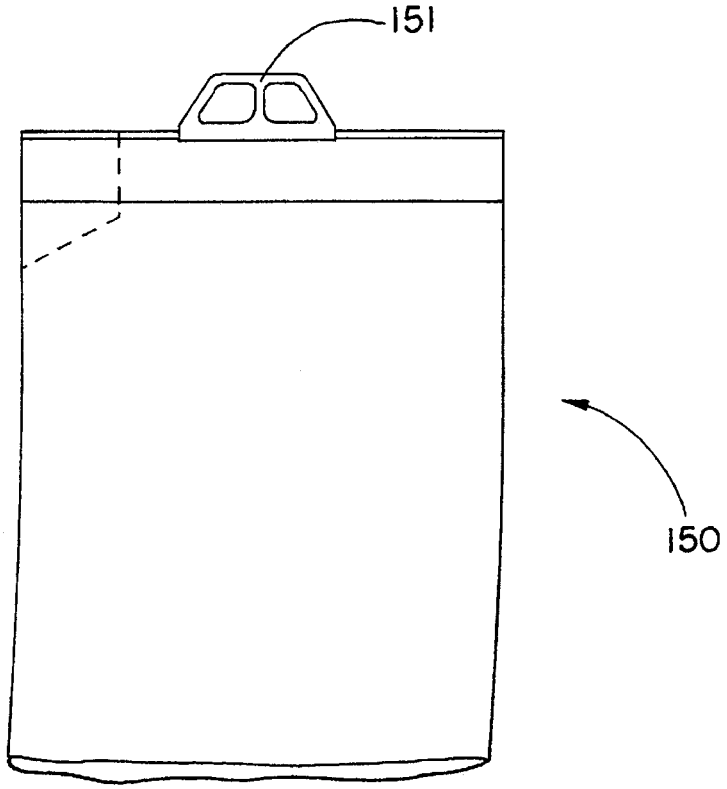
FIG. 10 is a side elevation of a further embodiment of a bag according to yet another design, with a separately-formed and attached handle.

FIG. 10 illustrates that different types of handles can be used in lieu of the die cut handle illustrated in FIGS. 1–9. In FIG. 10, a bag 150 includes a handle 151 which is a separate, molded plastic handle, separately formed and heat-bonded to the top end edge of the bag 150. Bag 150 also includes a pourer 152 as in FIG. 8.

Figure 11:
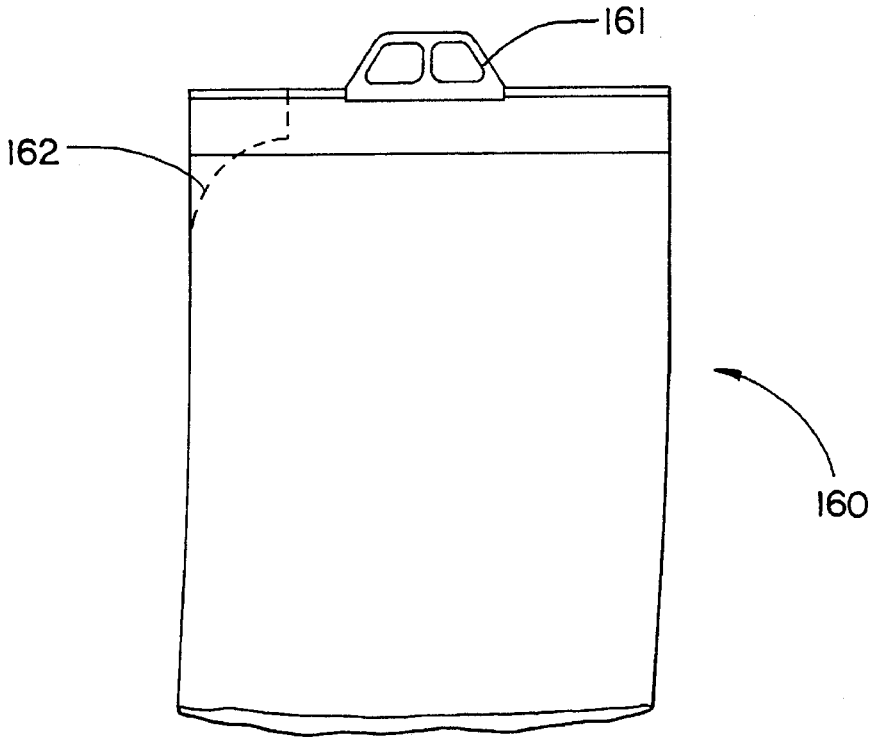
FIG. 11 is a side elevation of a further embodiment of a bag according to yet another design, with a different pourer design.

FIG. 11 illustrates that different types of pourers can be used in lieu of the pourer illustrated in FIG. 10. In FIG. 11, a bag 160 includes a handle 161 which is a separate, molded plastic handle, separately formed and heat-bonded to the top end edge of the bag 160. A pourer 162 as in FIG. 5 is provided.

Bags of the type disclosed in this application are used for heavy-duty applications, such as for transport and storage of materials such as salt, fertilizer, potting soil and the like. The bags are typically fabricated from a polyolefin sheet stock such as polyethylene having a thickness in the range of 3 to 12 mils. The sheet stock may be coextruded or monoextruded. The sheet stock may be single ply or multi-ply material. The multi-ply material may be multiple thicknesses of the same sheet stock, or different materials to provide particular characteristics, such as strength, flexibility, UV resistance, or color. The sheet stock may also be woven or non-woven synthetic or non-synthetic material.

The bags can be produced in flat tube, flat tube side gusset, flat tube back or edge seam, or flat tube side gusset back or edge seam styles. Bags designed to hold 40 pounds of material or less (usually 25 or 40 pound bags) are typically provided with a handle, as illustrated, while larger bags holding 50 or 80 pounds of material have no handles.

The preferred perforation pattern may be ⅛th inch perforation slits separated by ⅛th inch bridges, providing four perforations per inch. Perforations in the range of 1/16th to ⅜th inch with correspondingly sized bridges may also be used depending on the weight of the bag, the materials to be placed in the bag and similar considerations.

A heavy-duty bag with an easily removable corner for pouring is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a bag including first and second walls having joined first and second opposed side edges, an end edge and at least one seal line spaced from the end edge and extending laterally from one side to the other for sealing closed the end of the bag, the improvement comprising an easy-open corner portion of the bag removable to form a pourer, said corner portion comprising:

(a) a cut formed in both side walls closer to one side edge than the other and communicating with the end edge of the bag and extending towards the spaced-apart seal line;

(b) a plurality of closely spaced-apart perforations in both side walls extending in a line from within close proximity of said cut to the closer side edge and forming a tear line for permitting a portion of the side walls, including a portion of the end edge of the bag, to be torn away from the bag in a progressive tearing motion to form a hole in the bag from which the contents can be poured without interference from a remaining portion of the end edge of the bag; and (c) said perforated line having a first segment extending perpendicular to the end edge and parallel to the first and second side edges, and a second segment extending in a curved line convex towards the end edge, whereby said first and second segents cooperate when torn to define a predetermined size and shape of the pourer.

2. A bag according to claim 1, wherein said bag includes two spaced-apart seal lines adjacent the end edge of the bag, an area between the two spaced-apart seal lines including an opening defining a handle.

3. A bag according to claim 2, wherein said handle comprises a U-shaped, die-cut slit.

4. A bag according to claim 2, wherein said handle comprises a separately-formed handle assembly attached to the bag adjacent its end edge.

5. In a bag including first and second polyolefin walls with a thickness of between 3 and 12 mils and having joined first and second opposed side edges, an end edge and at least one seal line spaced from the end edge and extending laterally from one side to the other for sealing closed the end of the bag, the improvement comprising an easy open corner portion of the bag removable to form a pourer, said corner portion comprising:

(a) a cut formed in both side walls closer to one side edge than the other and communicating with the end edge of the bag and extending towards the spaced-apart seal line;

(b) a plurality of closely spaced-apart perforations in both side walls extending in a line from within close proximity of said cut to the closer side edge and forming a tear line for permitting a portion of the side walls, including a portion of the end edge of the bag, to be torn away from the bag in a progressive tearing motion to form a hole in the bag from which the contents can be poured without interference from a remaining portion of the end edge of the bag, and (c) said perforated line having a first sediment extending perpendicular to the 2nd edge and parallel the first and second side edges, and a second segment extending in a curved line convex towards the end edge, whereby said first and second segments cooperate when torn to define a predetermined size and shape of the pourer.

6. A bag according to claim 5, wherein said side walls are monoextruded sheet stock.

7. A bag according to claim 5, wherein said side walls are coextruded sheet stock.

8. A bag according to claim 5, wherein said perforations are between 1/16th inch and 3/8th inch long.

9. A bag according to claim 5, wherein the perforations are between 1/16th inch and 3/8th inch apart from adjacent perforations.

* * * * *